United States Patent [19]

Röck et al.

[11] 4,436,357

[45] Mar. 13, 1984

[54] PULL-OUT GUIDE ASSEMBLY FOR DRAWERS, SHELVES OR THE LIKE

[75] Inventors: Erich Röck; Josef Brunner, both of Höchst, Austria

[73] Assignee: Julius Blum Ges. m.b.H., Höchst, Austria

[21] Appl. No.: 347,234

[22] Filed: Feb. 8, 1982

[30] Foreign Application Priority Data

Feb. 19, 1981 [AT] Austria ..... 746/81

[51] Int. Cl.[3] ..... F16C 21/00

[52] U.S. Cl. ..... 312/338; 312/339; 312/341 R; 308/3.8

[58] Field of Search ..... 312/330 R, 337, 338, 312/339, 340, 341 R; 308/3.8

[56] References Cited

U.S. PATENT DOCUMENTS

| | | | |
|---|---|---|---|
| 1,454,494 | 5/1923 | Thomas | 312/337 |
| 1,994,424 | 3/1935 | Brantingson | 312/340 |
| 2,376,121 | 5/1945 | Clark | 312/337 |
| 2,564,658 | 8/1951 | Jakeway | 312/337 |
| 2,836,469 | 5/1958 | Yorinks | 312/339 |
| 3,203,749 | 8/1965 | Bullock et al. | 312/339 |
| 3,431,042 | 3/1969 | Pipe | 312/339 |
| 4,348,063 | 9/1982 | Chambers | 312/339 |
| 4,376,555 | 3/1983 | Grass | 312/341 R |

FOREIGN PATENT DOCUMENTS

| | | | |
|---|---|---|---|
| 334982 | 12/1958 | Switzerland | 312/339 |
| 783826 | 10/1957 | United Kingdom | 312/339 |

*Primary Examiner*—Victor N. Sakran

*Attorney, Agent, or Firm*—Wenderoth, Lind & Ponack

[57] ABSTRACT

A pull-out guide assembly for drawers includes on each side of the drawer, a supporting rail and a pull-out rail. A roller carrier is situated between each such pair of rails. The supporting rail on one side of the drawer has an open U-shaped profile, and the supporting rail on the other side has a ⊐-shaped profile with an outer vertical flange. Guide rollers are situated in the roller carrier. At least one guide roller runs on the outer vertical flange of the supporting rail and on a vertical flange of the pull-out rail. At least one other guide roller runs between an inner vertical flange of the supporting rail and another vertical flange of the pull-out rail.

4 Claims, 5 Drawing Figures

PULL-OUT GUIDE ASSEMBLY FOR DRAWERS, SHELVES OR THE LIKE

BACKGROUND OF THE INVENTION

1. Field of the Invention

The invention relates to a pull-out guide assembly for drawers, shelves or the like, comprising on each side of the drawer one supporting rail mounted on the side panel of the body of a piece of furniture, one pull-out rail on the side of the drawer at the bottom of the drawer and a roller carrier situated between these rails, load-transmitting rollers and lateral guide rollers being retained in the roller carrier.

2. Description of the Prior Art

Pull-out guide assemblies of the above-mentioned type allow smooth movement of the drawer or shelf and are, further, adapted to carry relatively heavy loads. The production costs of the roller carrier of injection-moulded plastics material and of the rollers arranged therein are low, and they have the same or even better sliding characteristics than pull-out guide assemblies with ball bearing rollers fastened to their rails.

It is important with such pull-out guide assemblies that the drawer move as smoothly as possible and, further, that the drawer is retained in a manner to provide lateral stability. Thus, tilting and wobbling of the drawer during the pull-out and push-in movements are prevented.

SUMMARY OF THE INVENTION

It is the object of the invention to provide a pull-out guide assembly of the above-described type in which high lateral stability is obtained, thereby ensuring a particularly smooth movement of the drawer.

According to the invention, this is achieved by adapting the guide rollers to run, at least on one side of the drawer or shelf, on both sides of the pull-out rail and each on an opposite flange of the supporting rail, such guide rollers being arranged above and below the horizontal flange of the pull-out rail having a ⊢ shaped-profile or a ⊢⊥shaped-profile.

Regarding the arrangement of the guide rollers, it is advantageously provided that four guide rollers are retained in the roller carrier, such guide rollers being positioned as at the corners of a rhomboid.

A further embodiment of the invention provides that on the other side of the drawer or shelf, the supporting rail and the pull-out rail have fully open profiles, preferably U- or Z-shaped profiles.

Due to this arrangement, conventional tolerances are possible, when manufacturing and mounting the supporting rails and pull-out rails, as the drawer or shelf is at one side guided with exact lateral stability and at the other side provided with fully open profiles, which make it possible to push the pull-out rail and the supporting rail into one another to a greater or smaller extent, obviously only within a certain range.

Particularly advantageous results have been obtained with respect to smooth movement of the pull-out assembly by arranging two guide rollers in the vicinity of each roller.

BRIEF DESCRIPTION OF THE DRAWINGS

In the following, an embodiment of the invention will be described in greater detail by means of the accompanying of the drawings, without being limited thereto, and wherein.

DESCRIPTION OF THE PREFERRED EMBODIMENT

Figure 1:
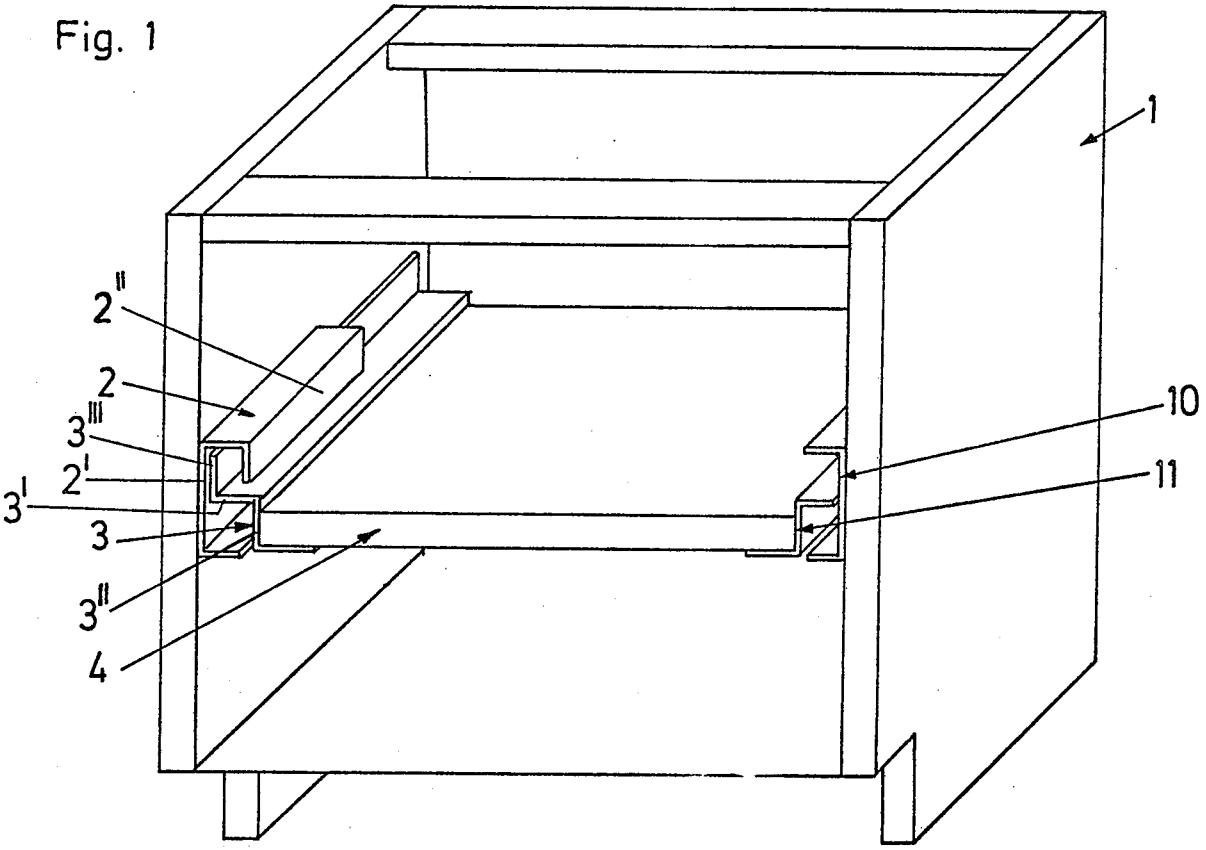
FIG. 1 is a schematic view of a body of a piece of furniture with a shelf guided in a pull-out guide assembly according to the invention.

Supporting rails 2, 10 are fastened to side walls 1 of the body of a piece of furniture. The supporting rail 10 on one side is a conventional U-shaped rail having only a single vertical flange.

On a shelf or drawer 4, a pull-out rail 3 is arranged on the side of the supporting rail 2 and a pull-out rail 11 is arranged on the side of the supporting rail 10.

The pull-out rail 11 is a conventional Z-shaped rail having only a single vertical flange.

The supporting rail 2 has a ⊏-shaped profile, and the pull-out rail 3 has a ⊢⊥-shaped profile.

Roller carriers are arranged between the supporting rails 2, 10 and the respective pull-out rails 3, 11. A conventional roller carrier, which is known in the art and therefore is not subject of the present invention, is arranged between the supporting rail 10 and the pull-out rail 11. The roller carrier is, therefore, not shown in the drawings.

Figure 2:
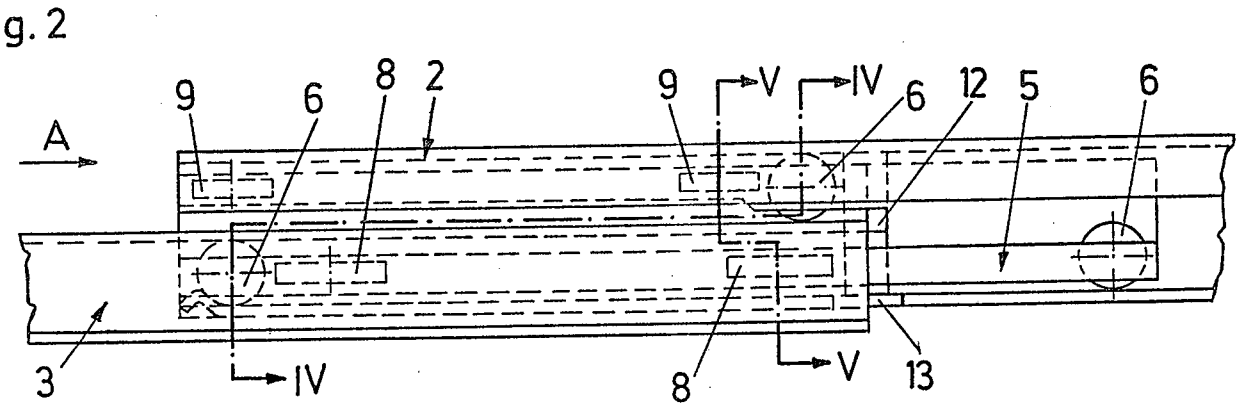
FIG. 2 is a side view of the pull-out guide assembly according to the invention.

A roller carrier 5, which can best be seen in FIG. 2, is positioned between the supporting rail 2 and the pull-out rail 3.

Rollers 6 and lateral guide rollers 8 and 9 with vertical axes are arranged in the roller carrier 5.

In the illustrated embodiment, the rollers 6 are arranged in the form of a triangle, two rollers 6 being arranged below a horizontal flange 3' of the pull-out rail 3 and one roller 6 being arranged above horizontal flange 3'.

Above the front roller 6 is arranged a guide roller which is also positioned above the horizontal flange 3' of the pull-out rail 3. A guide roller 8 is arranged laterally immediately behind the roller 6, such guide roller 8 running on a lower and inner vertical vertical flange 3'' of the pull-out rail 3 and, further, on a vertical flange 2' of the supporting rail 2. The guide roller 9 runs on an inner vertical flange 2'' of the supporting rail 2 and on an upper and outer vertical flange 3''' of the pull-out rail 3.

Guide rollers 8, 9 are arranged in a similar manner with respect to the central roller 6. Thus, one guide roller 8 is positioned below the central roller 6 and below the horizontal flange 3' of the pull-out rail 3, and one guide roller 9 is mounted immediately in front of the central roller 6.

Figure 3:
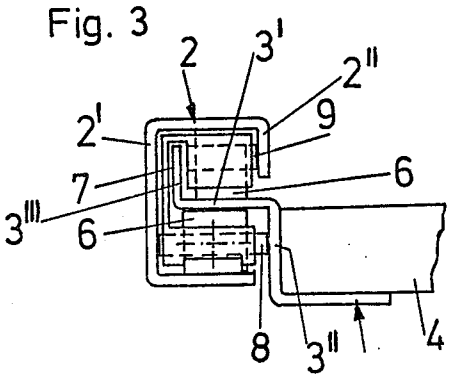
FIG. 3 is an end view from the direction of arrow A of FIG. 2.
Figure 4:
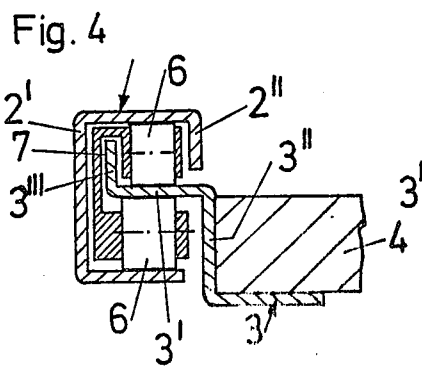
FIG. 4 is a sectional view along line IV—IV of FIG. 2.
Figure 5:
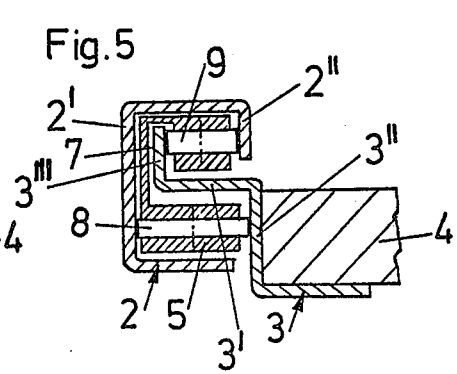
FIG. 5 shows a sectional view along line V—V of FIG. 2.

Best shown in FIGS. 3 and 5 is the manner in which the guide rollers 8, 9 roll on the pull-out rail 3 on both sides thereof and rest against an oppositely arranged flanges 2'' and 2', respectively, of the supporting rail 2.

The roller carrier 5 is provided with a groove-like recess 7 into which the outer flange 3''' of the pull-out rail 3 extends.

The roller carrier 5 is advantageously formed by injection moulded plastic material, and so are the rollers 6 and the guide rollers 8, 9.

Moreover, the roller carrier 5 in the illustrated embodiment is provided with a slide member 12 engaging in a punched hole 13 of the supporting rail 2 and, thus, locking the roller carrier 5, when the drawer or shelf and the pull-out rail 3 have been fully pulled out. The manner and means for locking and releasing the roller carrier 5 are also known in the art and have, for example, been described in the DE-OS No. 26 06 603.

Due to the embodiment of the pull-out guide assembly according to the invention, the pull-out rail 3 and, hence, the drawer or shelf 4 are on the one side precisely laterally guided in the supporting rail 2. Due to the fact that the supporting rail 10 and the pull-out rail 11 on the other side have profiles which are open with respect to one another, certain tolerances in the direction of the side of the shelf or drawer 4 are possible, when manufacturing the body of the piece of furniture and mounting the rails.

What is claimed is:

1. In a pull-out guide arrangement for use on opposite sides of a drawer, shelf or the like for guiding movement thereof into and out of a body of a piece of furniture, said arrangement being of the type including, for use on respective opposite sides of the drawer, shelf or the like, first and second assemblies each comprising a supporting rail adapted to be mounted on a side panel of the body of the piece of furniture, a pull-out rail adapted to be mounted on the respective side of the drawer, shelf or the like, a roller carrier positioned between said supporting and pull-out rails, and rollers retained by said roller carrier, the improvement wherein:

said first assembly comprises:

a said supporting rail having spaced outer and inner vertical flanges and spaced upper and lower horizontal flanges;

a said pull-out rail having outer and inner vertical flanges extending in opposite directions from opposite ends of a horizontal flange;

a said roller carrier positioned between said supporting and pull-out rails;

said rollers including plural cylindrical vertical load bearing rollers retained by said roller carrier, at least one said vertical load bearing roller being in rolling contact with said upper horizontal flange of said supporting rail and said horizontal flange of said pull-out rail, and at least one said vertical load bearing roller being in rolling contact with said horizontal flange of said pull-out rail and said lower horizontal flange of said supporting rail; and said rollers further including plural cylindrical, lateral guide rollers retained by said roller carrier, at least one said guide roller being above said horizontal flange of said pull-out rail and in rolling contact with a first said vertical flange of said supporting rail and a first said vertical flange of said pull-out rail, and at least one said guide roller being below said horizontal flange of said pull-out rail and in rolling contact with a second said vertical flange of said supporting rail and a second said vertical flange of said pull-out rail; and said second assembly comprises said supporting and pull-out rails each having only a single vertical flange;

whereby said first assembly provides precise lateral stability for the drawer, shelf or the like, and said second assembly is laterally open to allow for manufacturing tolerances of the drawer, shelf or the like.

2. The improvement claimed in claim 1, wherein said first assembly comprises four said lateral guide rollers retained by said roller carrier in a generally parallelogram arrangement, with a first said guide roller being above a said forward load bearing roller, a second said guide roller being immediately rearward of said forward load bearing roller, a third said guide roller being immediately forward of a said central load bearing roller, and a fourth said guide roller being below said central load bearing roller.

3. The improvement claimed in claim 1, wherein said first assembly comprises four said lateral guide rollers retained by said roller carrier in a generally parallelogram arrangement.

4. The improvement claimed in claim 1, wherein for said first assembly, said outer and inner vertical flanges of said pull-out rail extend upwardly and downwardly, respectively, of said horizontal flange of said pull-out rail, said at least one guide roller above said horizontal flange of said pull-out rail being in rolling contact with said inner vertical flange of said supporting rail rail and said outer vertical flange of said pull-out rail, and said at least one guide roller below said horizontal flange of said pull-out rail being in rolling contact with said outer vertical flange of said supporting rail and said inner vertical flange of said pull-out rail.

* * * * *